US007013985B2

(12) United States Patent
Sasaki et al.

(10) Patent No.: US 7,013,985 B2
(45) Date of Patent: Mar. 21, 2006

(54) PNEUMATICALLY OPERATED SCREW DRIVER

(75) Inventors: Yasuo Sasaki, Hitachinaka (JP); Takeshi Kamo, Hitachinaka (JP); Michio Wakabayashi, Hitachinaka (JP); Haruhiko Oouchi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/954,240

(22) Filed: Oct. 1, 2004

(65) Prior Publication Data

US 2005/0072275 A1 Apr. 7, 2005

(30) Foreign Application Priority Data

Oct. 1, 2003 (JP) ..... P2003-343294

(51) Int. Cl.
*B25B 21/00* (2006.01)

(52) U.S. Cl. ..... 173/11; 173/13; 173/93.5; 81/57.44; 81/434

(58) Field of Classification Search ..... 173/11, 173/13, 93.5; 81/57.44, 57.37, 433, 434
See application file for complete search history.

(56) References Cited

U.S. PATENT DOCUMENTS 2,818,893 A * 1/1958 Shaff ..... 81/430
5,730,035 A * 3/1998 Ohmori et al. ..... 81/57.44
6,026,713 A 2/2000 Ohmori et al.
6,061,901 A * 5/2000 Tanaka ..... 29/798
6,672,404 B1 * 1/2004 Kamo et al. ..... 173/11
6,782,957 B1 * 8/2004 Fujiyama ..... 173/93.5
6,843,400 B1 * 1/2005 Lee ..... 227/8
6,880,431 B1 * 4/2005 Wakabayashi et al. ..... 81/57.44
6,942,042 B1 * 9/2005 Lee ..... 173/11

FOREIGN PATENT DOCUMENTS

JP 11300639 11/1999

* cited by examiner

*Primary Examiner*—Scott A. Smith
(74) *Attorney, Agent, or Firm*—Antonelli, Terry, Stout and Kraus, LLP.

(57) ABSTRACT

A compact and light-weight pneumatically operated screw driver providing high speed screw fastening with high operability. A rotary member rotationally driven by a pneumatic motor includes a main rotary member made from a plastic material and a sliding segment fixed to the main rotary member. A rotation slide member is axially slidably movable relative to the rotary member and is rotatable together with the rotation of the rotary member. A shut-off section is provided on which the rotation slide member is rotationally seated when the rotation slide member is moved toward the shut-off section. The rotation slide member is made from an elastic material. A sleeve like piston having a seal ring in sliding contact with a cylinder is provided. The seal ring shuts off a supply of compressed air to the pneumatic motor only by the seating of the rotation slide member onto the shut-off section.

16 Claims, 6 Drawing Sheets

PNEUMATICALLY OPERATED SCREW DRIVER

CROSS-REFERENCE TO THE RELATED APPLICATION

The present application is closely related to the commonly assigned co-pending U.S. Patent applications titled "pneumatically operated screw driver" filed Sep. 3, 2004 (priority date: Sep. 19, 2003, Ser. No. 10/933,326 1297.44201X00), and to another commonly assigned co-pending U.S. patent application titled "pneumatically operated screw driver" (priority date Oct. 1, 2003, Base: JP2003-343293 and JP2003-343295)

BACKGROUND OF THE INVENTION

The present invention relates to a pneumatically operated screw driver providing an axially driving force by a piston and rotational force by a pneumatic motor for screwing a threaded fastener into a woody member or the like.

U.S. Pat. No. 6,026,713 discloses a pneumatically operated screw driver including a driver bit engageable with a groove formed in a head of the fastener. The driver bit is connected to a piston which is driven in an axial direction of the driver bit upon application of a pneumatic pressure to one side of the piston. Further, a pneumatic motor is provided for rotating a rotary member. A rotation slide member is axially movable relative to the rotary member, and is rotatable together with the rotation of the rotary member. The piston is connected to the rotation slide member. Thus, the driver bit is axially movable while being rotated about its axis for screwing the fastener into a target. Further, a bumper is provided so as to absorb kinetic energy of the piston moving to its bottom dead center. An operation valve associated with a trigger is provided for opening a main valve in order to apply pneumatic pressure onto the piston.

The disclosed screw driver also includes a return chamber to which a compressed air is accumulatable for applying compressed air to the piston in order to move the piston and the driver bit to their initial positions. Accumulation of the compressed air into the return chamber is started when the piston is about to reach its bottom dead center. When the screw fastening operation is terminated upon abutment of the piston onto the bumper, the compressed air accumulated in the return chamber will be applied to an opposite side of the piston so as to return the piston and the driver bit to their original positions. Such conventional pneumatically operated screw driver is also disclosed in laid open Japanese Patent Application Publication No. H11-300639.

Recently, high speed screw fastening is needed, such as a screw fastening frequency the same as a nail driving frequency of a nail gun. In order to increase rotation speed of the driver bit, a pneumatic motor must provide high output. To this effect, new problems arise as to excessive frictional wear of components, particularly rotational components and heat generation of these components due to the excessive friction. To overcome the new problems, a material of the rotational components must be limited to a metal in view of heat resistivity.

SUMMARY OF THE INVENTION

It is therefore an object of the present invention to provide a compact and light-weight pneumatically operated screw driver providing high speed screw fastening with high operability.

Another object of the present invention is to provide such screw driver avoiding fuse-bonding and any generation of scratch at sliding surfaces of mutually sliding components due to frictionally wearing particles released from the components.

Still another object of the present invention is to provide such screw driver ensuring stop of a supply of compressed air to the pneumatic motor at the terminal phase of the screw driving operation.

Still another object of the present invention is to provide such screw driver capable of avoiding excessive rotation of the rotary member at a terminal phase of the screw driving operation in order to avoid excessive screwing operation.

These and other objects of the present invention will be attained by a pneumatically operated screw driver including an outer frame, a pneumatic motor, a cylindrical rotary member, a rotation slide member, a shaft member, a driver bit, and a cylinder. The pneumatic motor is disposed in the outer frame and is rotatable about its axis. The cylindrical rotary member extends in an axial direction of the pneumatic motor and is rotatable within the outer frame by the rotation of the pneumatic motor. The rotary member has an inner peripheral surface formed with a rotation transmission portion. The rotary member includes a main rotary member made from a plastic material and having an end at a side opposite to the pneumatic motor, and a sliding segment fixed to the end of the main rotary member and made from a metal. The rotation slide member is disposed within the rotary member and is slidable in the axial direction relative to the rotary member. The rotation slide member has an engagement portion engaged with the rotation transmission portion so as to be rotatable together with the rotation of the rotary member. The shaft member has one end portion connected to the rotation slide member and another end portion provided with a driver bit holding section and a piston section. The driver bit is connected to the driver bit holding section. The cylinder is fixedly disposed in the outer frame and extends in the axial direction. One of the outer frame and the cylinder provides a contact part with which an end face of the sliding segment is in rotational sliding contact.

In another aspect of the invention, there is provided a pneumatically operated screw driver including the outer frame, the pneumatic motor, a cylindrical rotary member, a rotation slide member, the shaft member, the driver bit, and a cylinder. The cylindrical rotary member extends in an axial direction of the pneumatic motor and is rotatable within the outer frame by the rotation of the pneumatic motor. The rotary member has an inner peripheral surface formed with a rotation transmission portion. The rotation slide member is disposed within the rotary member and is slidable in the axial direction relative to the rotary member. The rotation slide member includes a main section and an engagement portion protruding from the main section for engagement with the rotation transmission portion so as to be rotatable together with the rotation of the rotary member. At least the main section is entirely made from an elastic material. The cylinder is fixedly disposed in the outer frame and extends in the axial direction. The cylinder has an upper portion providing a shut-off section in sealing contact with at least the main section of the rotation slide member when the piston section reaches its bottom dead center for shutting off a compressed air passage directing to the pneumatic motor.

DETAILED DESCRIPTION OF THE PREFERRED EMBODIMENTS

Figure 1:
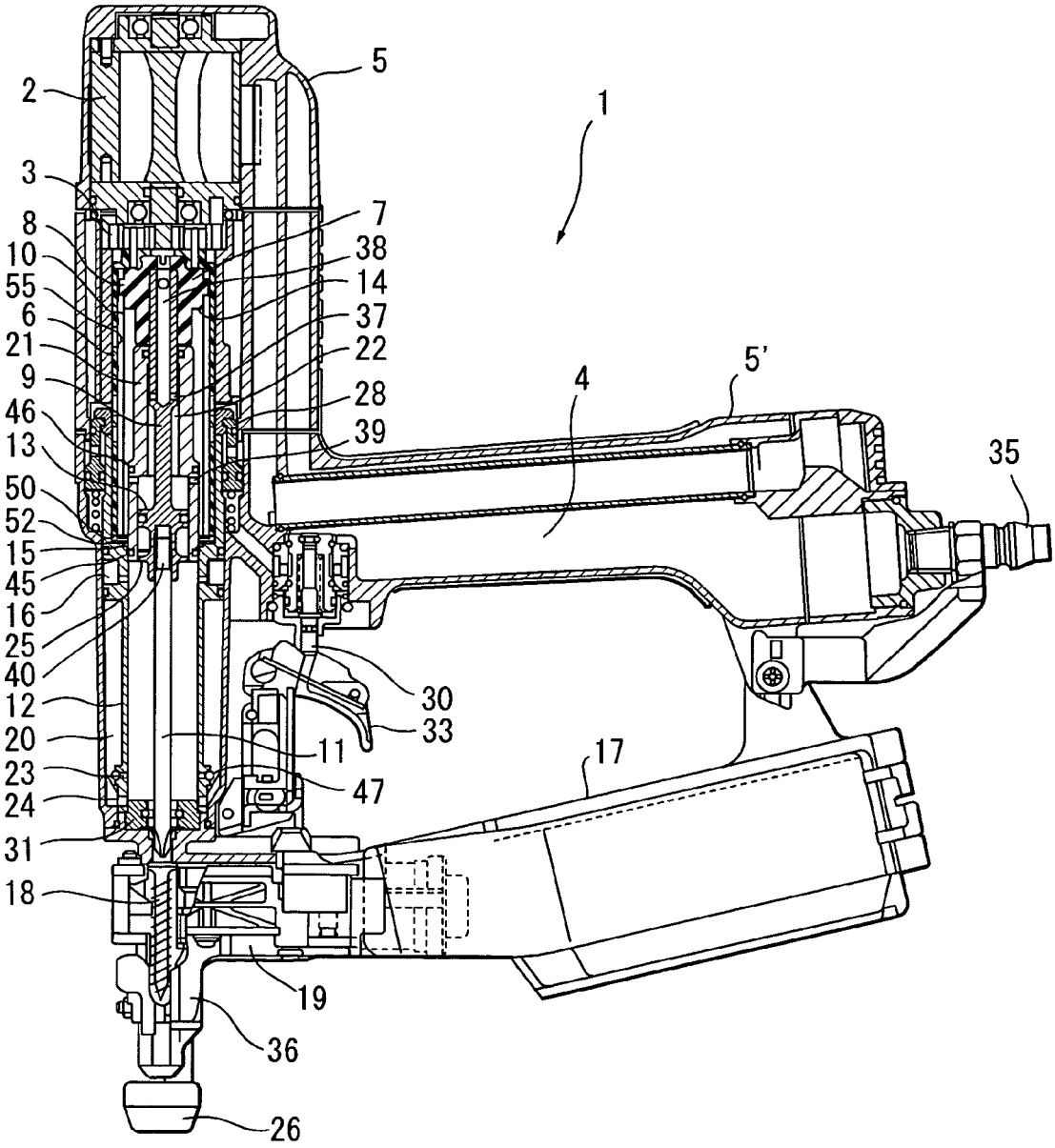
FIG. 1 is a partial cross-sectional side view showing an initial state of a screw driver according to a first embodiment of the present invention.

A pneumatically operated screw driver according to a first embodiment of the present invention will be described with reference to FIGS. 1 through 6. The directions used in the following description are defined based on a screw driver held in a vertical position with a driver bit extending downward and a grip extending rearward. Needless to say, the actual direction of the screw driver will be frequently changed due to its handiness when it is used.

A pneumatically operated screw driver 1 includes a body 5. The body 5 constitutes an outer frame of a main body. The body 5 includes a handle 5'. The body 5 has an inside space defining a compressed air chamber 4 extending from the handle 5' to an upper part of the body 5. The body 5 is made from a metal such as a magnesium, an aluminum, and alloy thereof, and the body 5 has an inner peripheral surface 55. The compressed air chamber 4 is in communication with an intake port 35 at the rear end of the handle 5' for introducing the compressed air. A trigger lever 33, an operation valve 30 opened or closed by the trigger lever 33, and a main valve 28 opened or closed by the operation valve 30 are provided at the body 5.

A pneumatic motor 2 is provided at the top of the body 5. The pneumatic motor 2 has a rotor rotatable about its axis when it receives the compressed air from the compressed air chamber 4. The rotor engages a planetary gear unit 3 to transmit the speed-reduced rotation to a rotary member 6. The rotary member 6 causes a rotation in synchronism with the rotation of the rotor.

Figure 4:
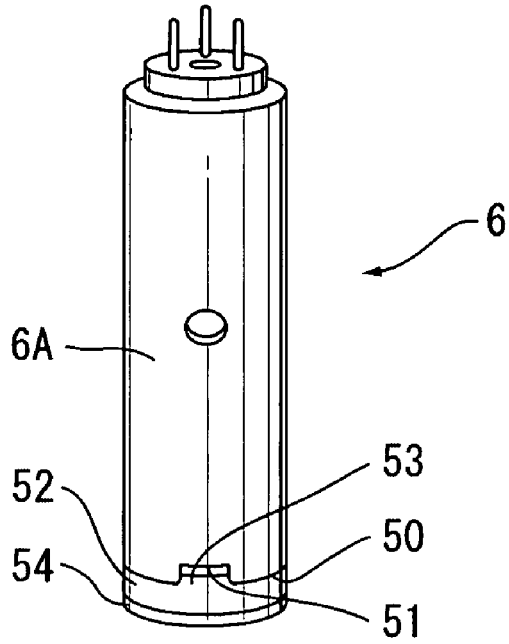
FIG. 4 is a perspective view showing a rotary member including a sliding member as a component of the pneumatically operated screw driver according to the first embodiment.

The rotary member 6 is in a cylindrical shape, and is roratably and directly supported by the body 5. For example, an outer peripheral surface of the rotary member 6 is loosely fitted with the inner peripheral surface 55 of the body 5 without interposing a thrust bearing therebetween. The rotary member 6 includes a main rotary member 6A (FIG. 4) made from a plastic material, a sintered metal member 52, and a washer 54 made from a metal such as steel or copper. As shown in FIG. 4, the main rotary member 6A has a lower edge 50 formed with two grooves 51. The sintered metal member 52 is porous, i.e., is formed with minute oil retaining holes. The sintered metal member 52 is fixed to the bottom surface 50. To this effect, the sintered metal member 52 has two projections 53 each engageable with each groove 51. The washer 54 is fixed to a bottom of the sintered metal member 52. Because a major part of the rotary member 6 is made from the plastic material, rotational inertial force can be lower than that of a case where the rotary member is entirely made from a metal. For example, a density of aluminum is three times as high as a density of plastic material. This can avoid over-rotation of the rotary member 6 at a terminal phase of the screw driving operation in order to avoid excessive screwing operation.

Figure 5:
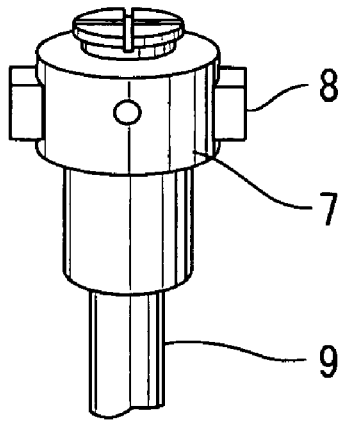
FIG. 5 is a perspective view showing a rotation slide member used in the pneumatically operated screw driver according to the first embodiment.

The rotary member 6 has an inner peripheral surface formed with a pair of grooves 10 extending in an axial direction thereof. Within the rotary member 6, a rotation slide member 7 is disposed. As shown in FIG. 5, the rotation slide member 7 has an upper portion from which a pair of projections 8 project radially outwardly and are slidingly engaged with the pair of grooves 10 for permitting the rotation slide member 7 to move in the axial direction relative to the rotary body 6. The rotation slide member 7 defines an air shielding surface 14. An entire portion of the rotation slide member 7 is made from an elastic material such as an urethane rubber. Even though the urethane rubber provides a frictional coefficient higher than that of an ordinary plastic material, the rotation slide member 7 can still provide a desirable axial sliding movement with respect to the rotary member 6 because the rotary member 6 is not made from a metal but is made from a plastic material.

A shaft 9 serving as an auxiliary piston extends in the longitudinal direction of the body 5. The shaft 9 has an upper end portion connected to the rotation slide member 7, an intermediate portion, and a lower portion. In the upper end portion and the intermediate portion, an air supply bore 38 extending in the axial direction of the shaft 9 and small diameter holes 37 extending in a radial direction thereof and in communication with the air supply bore 38 are formed for supplying a compressed air to a piston section 13 described later.

At the lower portion of the shaft 9, a driver bit assembling section 40, the piston section 13, and a flange section 25 are provided. The driver bit assembling section 40 is disposed at the lower end portion of the shaft 9 for assembling a driver bit 11. The piston section 13 is disposed as an outer peripheral section of the shaft 9 at a position immediately above the driver bit assembling section 40. The piston section 13 has an outer peripheral surface provided with an O-ring 13A. The flange section 25 is disposed as an outer peripheral section of the shaft 9 at a position below the piston section 13 for determining the termination of screw fastening operation. The flange section 25 has an outer diameter smaller than an outer diameter of the piston section 13.

A cylinder 12 is disposed in the body 5 and extends in the axial direction of the shaft 9. A main piston 21 is slidably disposed in the cylinder 12. The main piston 21 is positioned below the rotation slide member 7 and is disposed to surround a part of the shaft 9. That is, a lower part of the upper end portion, the intermediate portion, and the lower portion of the shaft 9 are surrounded by the main piston 21. The main piston 21 has a hollow section 22 including a top end through which the shaft 9 extends, an upper hollow section, and a lower hollow section. An inner diameter of the upper hollow section is greater than an outer diameter of the shaft 9 and is smaller than an outer diameter of the piston section 13. An inner diameter of the lower hollow section is greater than the inner diameter of the upper hollow section for allowing the piston section 13 to be in sliding engagement. That is, the O-ring 13A is in sliding contact with the lower hollow section. Further, the flange section 25 has an outer diameter smaller than the inner diameter of the lower hollow section. Therefore, a minute annular space is defined between the flange section 25 and the lower hollow section.

An O-ring 45 in sliding contact with the inner peripheral surface of the cylinder 12 is assembled at a lower outer peripheral surface of the main piston 21. Further, another O-ring 46 in sliding contact with the inner peripheral surface of the cylinder 12 is assembled at the outer peripheral surface and above the O-ring 45. Piston holes 39 are formed in the main piston 21 at a position between the O-rings 45 and 46 for providing communication between an interior and exterior of the main piston 21.

The rotation slide member 7 has a communication hole open at its upper surface, and the air supply bore 38 is in communication with an interior of the rotary member 6 through the communication hole. The small diameter holes 37 is adapted to communicate the air supply bore 38 with an inner space of the main piston 21.

A plate section 15 is provided at an upper portion of the cylinder 12 made from a metal. The plate section 15 is adapted to permit the air shield surface 14 of the rotation slide member 7 to be brought into abutment therewith when the rotation slide member 7 is moved descent down by a predetermined distance. The plate section 15 is integral with the cylinder 12. A vent hole 16 is formed below the plate section 15. The vent hole 16 is in communication with an air inlet opening (not shown) of the pneumatic motor 2 through a compressed air passage (not shown).

The above-described O-ring 46 is located at a position between the piston hole 39 and the compressed air passage directed to the pneumatic motor 2 when the main piston 21 reaches its bottom dead center. In other words, the O-ring 46 prevents the compressed air from being supplied to the vent hole 16 through the air supply bore 38, the small diameter holes 37 and the piston holes 39 after the main piston 21 reaches its bottom dead center.

A return chamber 20 is defined by a space between the lower portion of the body 5 and the outer peripheral surface of the cylinder 12. The lower portion of the cylinder 12 is formed with compressed air flowage holes 23 for introducing compressed air into the return chamber 20. A rubber ring 47 serving as a check valve is disposed over each outlet opening of the compressed air flowage holes 23 for preventing compressed air in the return chamber 20 to flow back into the cylinder 12. At the lower portion of the cylinder 12, a plurality of compressed air introduction holes 24 are formed at position below the compressed air flowage holes 23 for providing fluid communication between the return chamber 20 and the cylinder 12.

Figure 6:
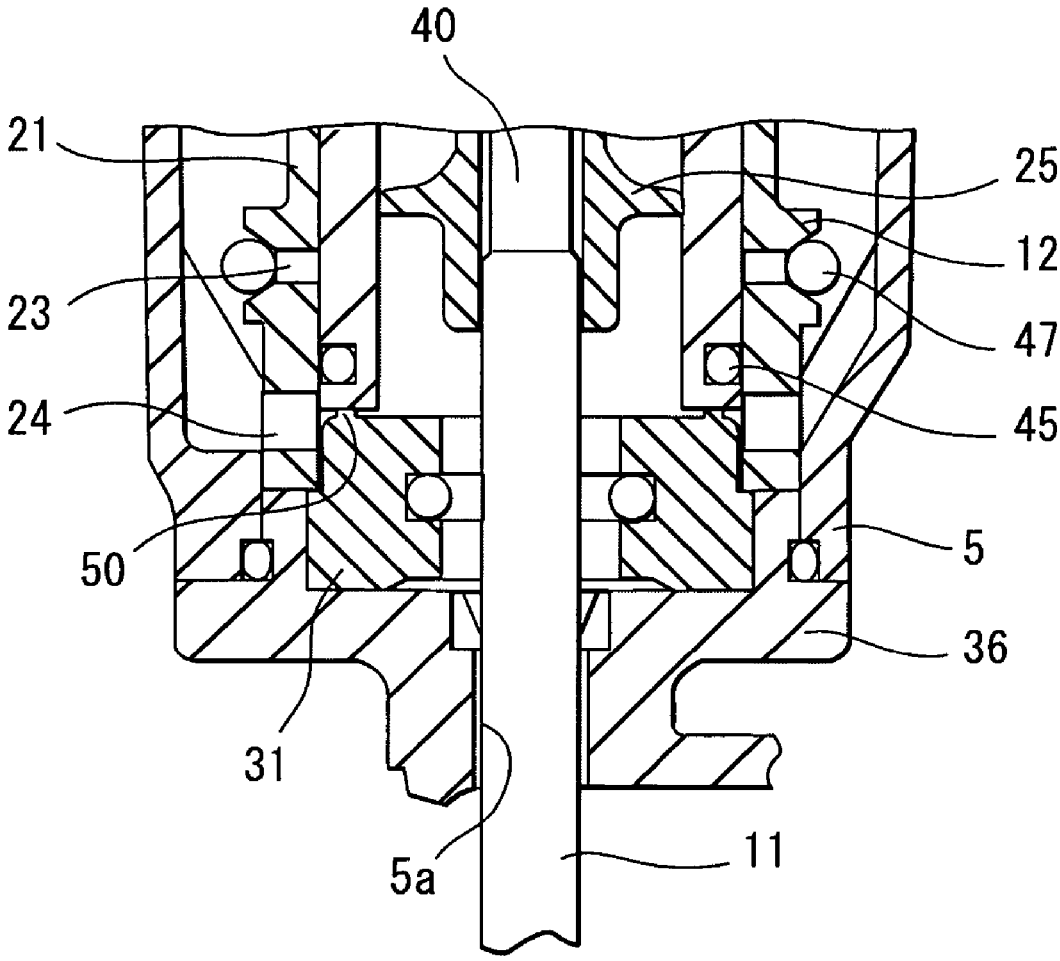
FIG. 6 is an enlarged cross-sectional view particularly showing a hole formed at a lowermost portion of a body.

A piston bumper 31 is provided at the lower portion of the cylinder 12. A bottom surface of the main piston 21 and the flange section 25 of the shaft 9 bump against the piston bumper 31 when the main piston 21 and the shaft 9 reach their bottom dead centers. More specifically, as shown in FIG. 6, the piston bumper 31 is provided with an annular abutment projection 50 on which the bottom end of the main piston 21 will abuts. An outer diameter of the bottom end of the main piston 21 is slightly greater than an outer diameter of the abutment projection 50.

A hole 5*a* is formed at the lowermost portion of the body 5 for allowing the driver bit 11 to pass therethrough. An inner diameter of the hole 5*a* is slightly greater than an outer diameter of the driver bit 11, so that a minute space is defined therebetween. This minute space serves as an air discharge passage through which an air within the cylinder 12 and below the piston section 13 can be discharged to the atmosphere during downward stroke of the piston section 13.

More specifically, in order to provide sufficient thrusting force or downward moving force of the piston section 13, a sufficiently large volume of air must be smoothly discharged through the minute space. Therefore, the minute space must be sufficiently large so as to facilitate this air discharge. On the contrary, the minute space must be sufficiently small so as to maintain sufficiently high pressure in the cylinder space below the piston section 13 in order to move back the shaft 9 upwardly after completion of fastener driving. The latter high pressure is supplied from the return air chamber 20 into the cylinder space below the piston section 13 through the compressed air introduction holes 24. Consequently, the area of the minute space is configured in an attempt to balance the conflicting requirements.

A nose portion 36 is provided to the lowermost portion of the body 5. A magazine 17 is connected to the body 5. The magazine 17 accommodates therein a plurality of screws arrayed side by side by an interlinking band (not shown). A screw feeder 19 is disposed in the magazine 17 and at a position adjacent to the nose portion 36 for automatically feeding a leading end screw of the screw array to the nose portion 36. A push lever 26 in interlocking relation to the operation valve 30 is provided at a position below the screw feeder 19.

Next, operation of the pneumatically operated screw driver thus constructed will be described.

In the screw driver, not only the operation valve 30 but also the push lever 26 are operated from the state shown in FIG. 1 so as to start driving operation. In this case, screw fastening can be achieved by pulling the trigger lever 33 after the push lever 26 is pushed against a workpiece (not shown), or by pressing the push lever 26 against the workpiece while the trigger lever 33 is being pulled.

When the compressed air intake port 35 is connected to a compressor (not shown), the compressed air is introduced into the compressed air chamber 4 and the operation valve 30. If the operation valve 30 is operated while the push lever 26 is pressed against the workpiece, the main valve 28 is opened, so that the compressed air is delivered into the rotary member 6 through the air passage (not shown). As a result, pneumatic pressure is applied to the upper surface of the main piston 21.

Further, pneumatic pressure is also applied to the upper surface of the piston section 13 of the shaft 9 because the compressed air can pass through the air supply bore 38 and the small diameter holes 37. Further, the compressed air leaked into a hollow space between the inner peripheral surface of the rotary member 6 and the outer peripheral surface of the main piston 21 is also applied to the upper surface of the piston section 13 through the piston holes 39 (see FIG. 1). Thus, the main piston 21 and the shaft 9 are urged downward.

If the descent movement of the piston section 13, i.e., the movement of the shaft 9 is decelerated due to the resistance incurred when the shaft 9 forcibly removes the screw 18 from the interlinking band, the main piston 21 catches up with the piston section 13 before the tip end of the screw 18 is driven into the workpiece. Consequently, the main piston 21 and the shaft 9 are integrally moved downwardly, so that the driver bit 11 drives the screw 18 into the workpiece. Incidentally, after the O-ring 46 of the main piston 21 starts sliding movement relative to the cylinder 12, compressed air through the piston holes 39 will not be applied to the upper surface of the piston section 13 of the shaft 9, because fluid passage from the piston holes 39 is blocked by the O-ring 46. In the latter case, the compressed air through the air supply bore 38 and the small diameter holes 37 will be applied to the upper surface of the piston section 13.

Immediately before the main piston 21 reaches its bottom dead center and when the O-ring 45 moves past the compressed air flowage hole 23, the compressed air flowage hole 23 starts flowing of the compressed air into the return chamber 20 through the air supply bore 38, the small diameter holes 37 and the piston holes 39.

When the main piston 21 is positioned at a position shown in FIG. 1, the O-ring 45 blocks the fluid passage from the interior of the rotary member 6 to the air vent hole 16. Therefore, compressed air supplied into the rotary member 6 cannot be delivered to the pneumatic motor 2. On the other hand, compressed air supplied into the rotary member 6 is supplied to the pneumatic motor 2 through the air vent hole 16 once the O-ring 45 moves past the air vent hole 16 for starting rotation of the pneumatic motor 2. It is unnecessary to rotate the pneumatic motor 2 at the initial stage. Instead, the rotation of the pneumatic motor 2 is started immediately before the driver bit 11 engages the grooves of the screw head. This can reduce consumption of the compressed air. The rotation of the pneumatic motor 2 is transmitted to the rotary member 6 and the rotation slide member 7 through the planetary gear unit 3.

If the O-ring 46 has not reached the cylinder 12 in the downward movement of the main piston 21, compressed air in the rotary member 6 is delivered to the air vent hole 16 by two routes. The first route is defined by the air supply bore 38, the small diameter holes 37, the piston holes 39, and a gap between the outer peripheral surface of the main piston 21 and the inner peripheral surface of the cylinder 12. The second route is defined by a gap between the rotary member 6 and the rotation slide member 7, and the gap between the outer peripheral surface of the main piston 21 and the inner peripheral surface of the cylinder 12. If the O-ring 46 reaches the cylinder 12, the above-described second route is blocked by the O-ring 46, and only the first route is effective for the delivery of the compressed air to the air vent hole 16. Then if the O-ring 46 moves past the air vent hole 16, the first route is blocked by the O-ring 46, and only the second route is made effective for the delivery of the compressed air to the air vent hole 16.

In the rotation phase of the rotary member 6, since the main rotary member 6A made from a plastic material and the metal member 52 are integrally rotated, no relative sliding movement occurs therebetween. Thus, heat generation of the rotary member 6 can be restrained. Further, since main rotary member 6A made from the plastic material is loosely rotatably supported within the body 5 made from the metal, a bearing such as a thrust bearing can be dispensed with between the rotary member 6 and the body 5. This leads to reduction in weight of the screw driver and provides stable depth of screw fastening. In other words, because the sliding relationship occurs between the plastic material and the metal, a problem of fuse-bonding can be avoided, the fuse-bonding may occur in case of the sliding relation between non-ferrous metals. Further, the rotary member 6 is only frictionally worn, which does not impart any surface injury to the opposing sliding member due to metallic wear particles released from the metal, since the main rotary member 6A is made from the plastic material and since the opposing sliding member (body 5) does not release metallic wear particles because of difference in hardness between plastic material and the metal. Moreover, excessive heat generation does not occur, because the constant contact between the rotary member 6 and the body 5 does not occur, but the rotary member 6 is loosely supported within the body 5. Moreover, because of the elimination of the bearing, a resultant outer diameter of the body 5 can be reduced to provide a compact screw driver.

Figure 2:
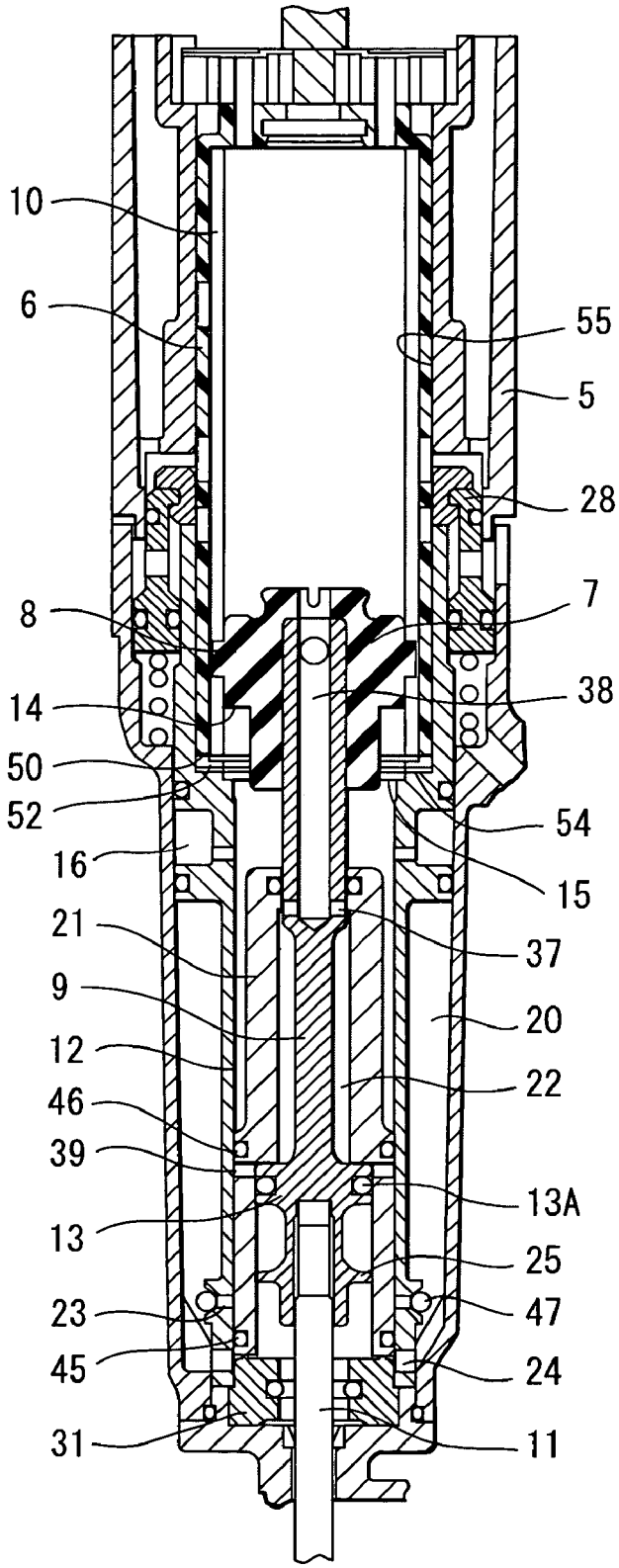
FIG. 2 is a cross-sectional side view showing an essential portion of the screw driver in its screw driving phase.

As shown in FIG. 2, after the main piston 21 reaches its bottom dead center, the driver bit 11 continues descent movement only by the thrust of the auxiliary piston, i.e., the shaft 9, so that the screw 18 can be screwed into the workpiece. In this case, since the bottom surface of the main piston 21, i.e., an abutment end of the main piston 21 is in intimate contact with the piston bumper 31, compressed air in the return chamber 20 cannot be entered into the lower space defined by the main piston 21 and the shaft 9. Consequently, the thrust of the piston section 13 can be maintained to avoid accidental disengagement of the tip end of the driver bit 11 from the screw head groove due to shortage of the thrust.

In this case, because the difference in the outer diameter of between the bottom end of the main piston 21 and the annular abutment projection 50 is small so as to provide a sufficiently small pressure application area at the bottom end of the main piston 21 for returning the main piston toward its top dead center, the main piston 21 can be maintained at the bottom dead center position even if the pressure level in the return chamber 20 is increased at the terminal phase of the screw fastening operation as long as the pressure level in the rotary member 6 is still sufficient to maintain the main piston 21 to its bottom dead center.

Figure 3:
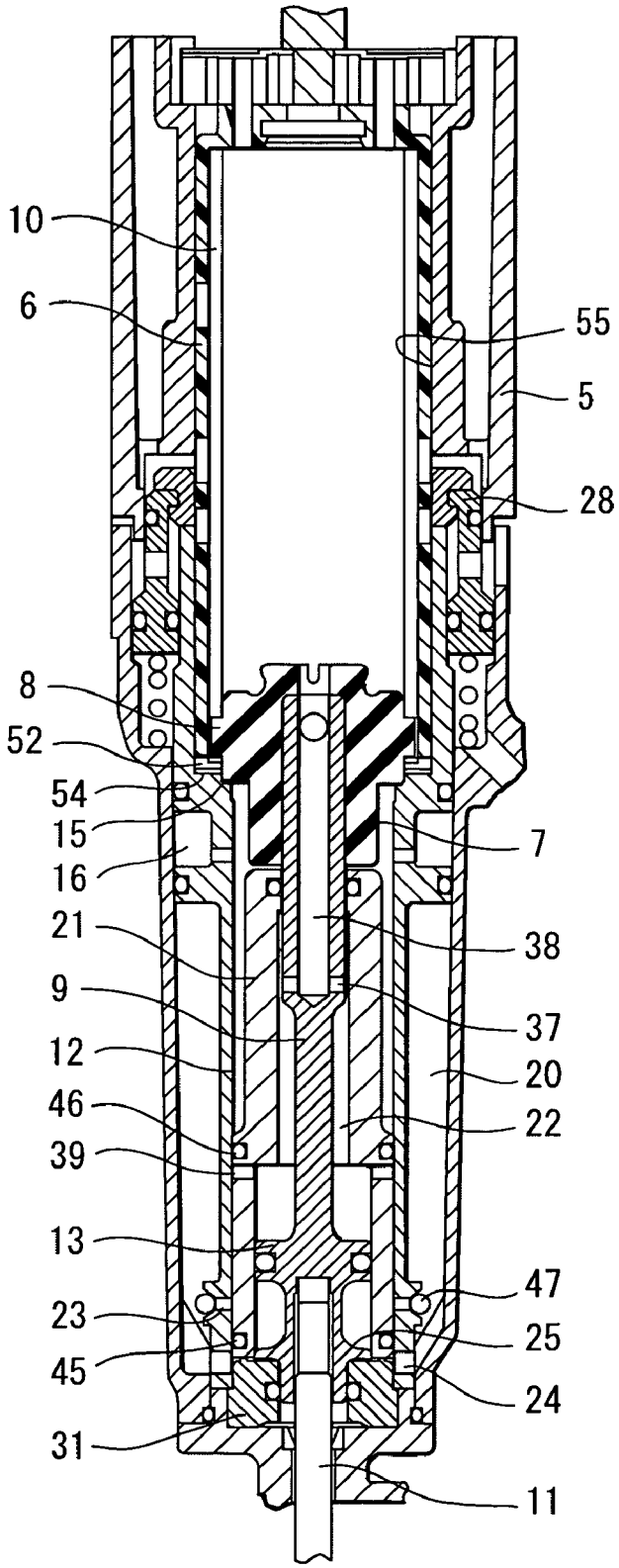
FIG. 3 is a cross-sectional side view showing the essential portion of the screw driver and showing just a completion phase of the screw driving operation.

When the screw 18 is fastened to a predetermined depth, the air shield surface 14 of the rotation slide member 7 abuts on the plate section 15 as shown in FIG. 3 to stop further descent motion of the rotation slide member 7. At the same time, the air communication between the rotary member 6 and the vent hole 16 will be blocked for stopping rotation of the pneumatic motor 2, thereby completing the screw driving operation. Because the above-described first route has already been blocked by the O-ring 46, it is only necessary to block the second route for stopping rotation of the pneumatic motor 2. To this effect, the second route can be simply blocked by the abutment of the rotary slide member 7 onto the plate section 15. Moreover, when the flange section 25 is seated on the bumper 31, the shaft 9 cannot be any more moved to terminate the fastening operation.

Here, because the space between the hole 5*a* and the driver bit 11 is sufficiently small, a pressure in the cylinder 12 below the piston section 13 is gradually increased in accordance with the downward movement of the piston section 13. This pressure increase resists downward movement of the piston section 13. However, because the flange section 25 is disposed below the piston section 13 and the annular space is defined between the flange section 25 and the cylinder 12, internal volume in the cylinder 12 and below the piston section 13 is sufficient in comparison with a case where no flange section is provided and a piston section is provided at the position of the flange section. Because the sufficiently large volume is provided, the degree of pressure increase in the volume can be moderated, which permits the piston section 13 to be smoothly moved downwardly even at the terminal phase of the fastening operation.

Further, since the rotation slide member 7 including the projections 8 and the shielding surface 14 is integrally molded with the elastic material, sealing performance relative to the plate section 15 can be improved to ensure the stop of the pneumatic motor 2. Furthermore, the O-ring 46 is assembled at the outer peripheral surface of the main piston 21 at such a position between the piston hole 39 and the air vent hole 16 when the main piston 21 has reached the bottom dead center. Therefore, compressed air is supplied to the pneumatic motor 2 through the air vent hole 16 only through the gap between the rotation slide member 7 and the rotary member 6 (only through the second route) near a terminal phase of the screw driving operation. This ensures stop of the pneumatic motor 2 only by the abutment of the rotation slide member 7 against the plate section 15.

If the operation valve 30 is released, compressed air in the rotary member 6 will be discharged to an atmosphere, and the compressed air in the return chamber 20 passes through the compressed air introduction hole 24 and is applied to the bottom face of the main piston 21 because the outer diameter of the bottom end of the main piston 21 is slightly greater than the outer diameter of the abutment projection 50.

In accordance with the movement of the main piston 21, air shielding between the main piston 21 and the piston bumper 31 becomes invalid, so that the compressed air from the return chamber 20 will be applied to the lower side of the piston section 13. Therefore, the piston section 13 and the driver bit 11 are returned to their original positions when the internal pressure within the rotary member 6 becomes lowered. Simultaneously, a subsequent screw 18 is fed to a position in alignment with the driver bit 11 by the screw feeder 19, and then the main piston 21 and the shaft 9 return to their initial positions.

Figure 7:
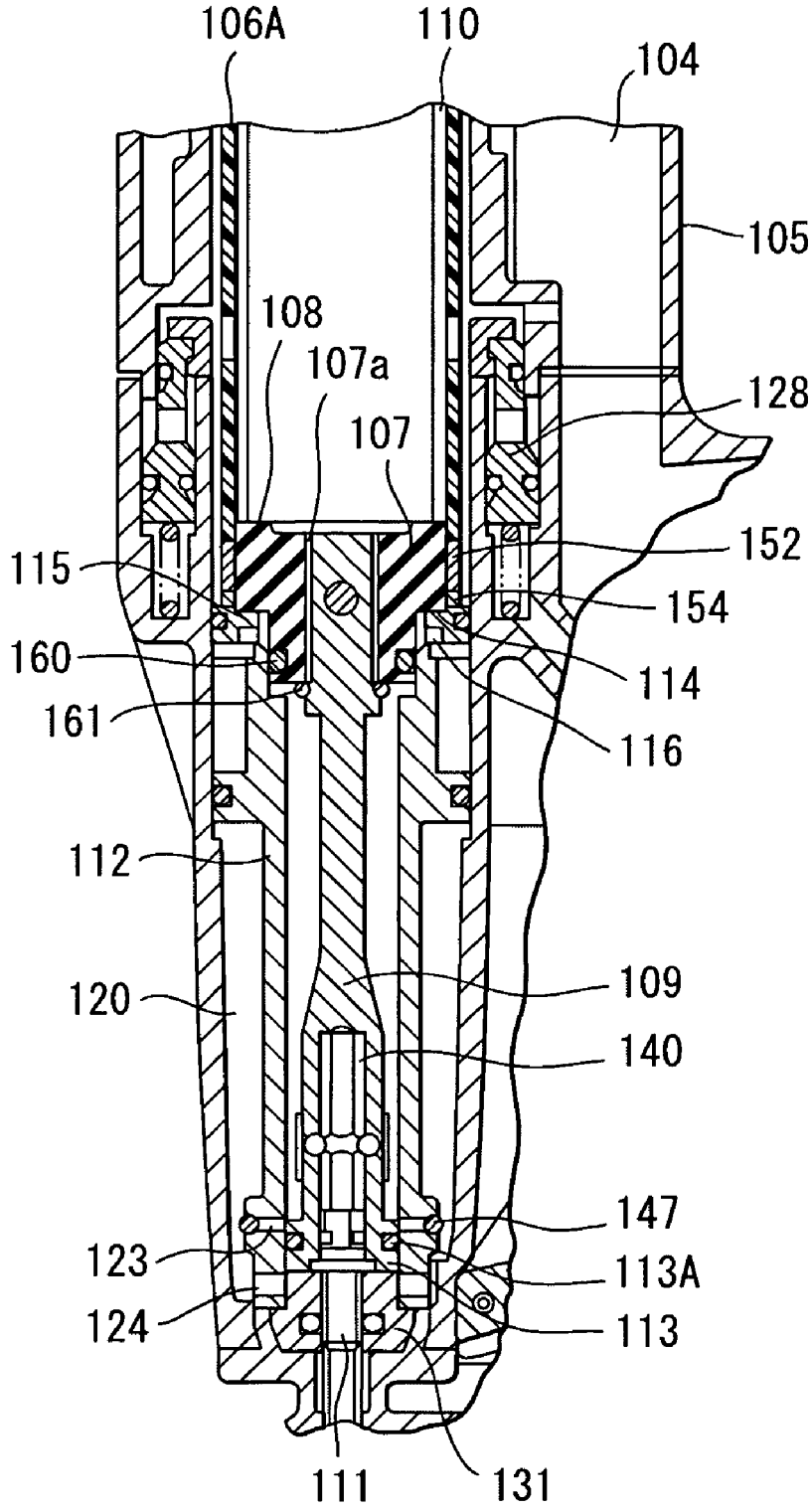
FIG. 7 is a partial cross-sectional side view showing a pneumatically operated screw driver according to a second embodiment of the present invention.

A pneumatically operated screw driver according to a second embodiment is shown in FIG. 7 wherein like parts and components are designated by the reference numerals added with "100" to the reference numerals of the corresponding parts in the first embodiment to avoid duplicating description. The second embodiment pertains to a modification described in U.S. Pat. No. 6,026,713 which is incorporated by reference.

In the second embodiment, a single piston 113 is provided instead of the combination of the main piston 21 and the auxiliary piston 9. Further, similar to the first embodiment, a rotary member includes a plastic main rotary member 106A, the sintered metal member 152, and the washer 154 made from a metal such as steel or copper. The main rotary member 106A has a lower edge formed with two grooves. The sintered metal member 152 is formed with minute oil retaining holes, and is fixed to the bottom surface. That is, the sintered metal member 152 has two projections each engageable with each groove. The washer 154 is fixed to a bottom of the sintered metal member 152.

Further, a rotation slide member 107 is entirely made from an urethane rubber, and is equipped with an O-ring 160 on its outer cylindrical surface. The O-ring 160 is adapted to seal the upper end of the inner wall of a cylinder 112. More specifically, the O-ring 160 prevents the compressed air within the cylinder 112 from being leaked into the air vent hole 116 at the time of completion of the screw fastening.

A shaft 109 has an upper end connected to the rotation slide member 107. The shaft 109 has an enlarged lower portion having an inside space serving as a driver bit holder 140 for holding a driver bit 111. The lowermost end of the enlarged lower portion of the shaft 109 serves as a piston 113. A seal ring 113A is provided on an outer cylindrical surface of the piston 113. With this seal ring 113A, the piston 113 is hermetically coupled with the inside wall of the cylinder 112. The piston 113 is slidable in the axial (i.e., up-and-down) direction along the inside wall of the cylinder 112.

A ventilation passage 107*a* extends across the rotation slide member 107 from the upper surface to the lower surface along the gap between the rotation slide member 107 and the shaft 109. An O-ring 161 is provided at the lower end of the ventilation passage 107*a*. The O-ring 161 acts as a one-way valve. Compressed air flowing manner is described in detail in the U.S. Pat. No. 6,026,713 which is incorporated by reference.

While the invention has been described in detail with reference to specific embodiments thereof, it would be apparent to those skilled in the art that various changes and modifications may be made therein without departing from the spirit and scope of the invention.

For example, in order to avoid excessive wear of the projections 8, the projections can be made by separate segments made from a metal such as steel and aluminum or high hardness plastic material. Even in the latter case, the grooves 10 of the rotary member 6 made from the plastic material does not cause frictional wearing, because the projections 8 is not in rotational sliding contact with the rotary member 6, but is in axial sliding contact therewith whose sliding speed is excessively lower than that of the rotational sliding contact.

Further, in the depicted embodiment, the plate section 15 is provided integrally with the cylinder 12. However, the plate section can be provided integrally with the body as long as the shielding surface 14 can be brought into abutment therewith.

Furthermore, in the depicted embodiment, the main rotary member 6A is formed with recess 51 and the sintered metal member 52 is provided with projection 53. However, the main rotary member can be provided with a projection and the sintered metal member 52 can be formed with a recess.

What is claimed is:

1. A pneumatically operated screw driver comprising:

an outer frame;

a pneumatic motor disposed in the outer frame and rotatable about its axis;

a cylindrical rotary member extending in an axial direction of the pneumatic motor and rotatable within the outer frame by the rotation of the pneumatic motor, the rotary member having an inner peripheral surface formed with a rotation transmission portion, the rotary member comprising a main rotary member made from a plastic material having an end at a side opposite to the pneumatic motor, and a sliding segment fixed to the end of the main rotary member and made from a metal;

a rotation slide member disposed within the rotary member and slidable in the axial direction relative to the rotary member, the rotation slide member having an engagement portion engaged with the rotation transmission portion so as to be rotatable together with the rotation of the rotary member;

a shaft member having one end portion connected to the rotation slide member and another end portion provided with a driver bit holding section and a piston section;

a driver bit connected to the driver bit holding section; and a cylinder fixedly disposed in the outer frame and extending in the axial direction, one of the outer frame and the cylinder providing a contact part with which an end face of the sliding segment is in rotational sliding contact.

2. The pneumatically operated screw driver as claimed in claim 1, wherein the outer frame is made from a metal, and wherein the rotary member is loosely supported by the outer frame without interposing a bearing therebetween.

3. The pneumatically operated screw driver as claimed in claim 1, wherein the end of the main rotary member is provided with one of recess and protrusion, and wherein the sliding segment is provided with one of complementary protrusion and recess engaged with the associated one of the recess and protrusion of the main rotary member.

4. The pneumatically operated screw driver as claimed in claim 1, wherein the inner peripheral surface of the rotary member is formed with an axial groove serving as the rotation transmission portion, and the rotation slide member has a protruding section engageable with the axial groove and serving as the engagement portion.

5. The pneumatically operated screw driver as claimed in claim 1, wherein the rotation slide member is entirely made from an elastic material.

6. The pneumatically operated screw driver as claimed in claim 5, wherein the cylinder has an end section serving as a shut-off section with which the rotation slide member is abuttable when the piston section reaches its bottom dead center for shutting off a compressed air passage directing to the pneumatic motor.

7. The pneumatically operated screw driver as claimed in claim 6, wherein the cylinder is formed with at least one compressed air introduction hole and at least one compressed air flowage hole, a return chamber being defined between the outer frame and the cylinder so that a compressed air is flowed from the cylinder to the return chamber through the air flowage hole and is flowed from the return chamber into the cylinder through the air introduction hole.

8. The pneumatically operated screw driver as claimed in claim 7, further comprising:

a sleeve piston slidably disposed in the cylinder and movable in the axial direction of the cylinder between its top dead center and a bottom dead center, the sleeve piston defining an inner space and an outer space and being formed with a first communication hole permitting fluid communication between the inner space and the outer space, the sleeve piston having an abutment end;

a first seal member disposed at the sleeve piston and in sealing contact with the cylinder;

a second seal member disposed at the sleeve piston and in sealing contact with the cylinder, the second seal member being positioned closer to the shut-off section than the first seal member to the shut-off section;

a bumper disposed at the cylinder, the abutment end of the sleeve piston and the piston section being abuttable on the bumper, the shaft member having a hollow section, an intermediate section, and another end portion provided with the piston section, at least the intermediate section and the another end portion being disposed in the inner space of the sleeve piston, and the piston section being slidably movable with respect to the sleeve piston, a second communication hole being formed at the intermediate section in communication with the hollow section and the inner space of the sleeve piston, the air flowage hole being positioned to allow compressed air in the inner space to direct into the return air chamber through the first communication hole after the first seal member moves past the air flowage hole during movement of the sleeve piston toward its bottom dead center and after the piston section passes the first communication hole and before the piston section reaches its bottom dead center.

9. The pneumatically operated screw driver as claimed in claim 8, wherein the outer frame has an inner peripheral surface and defines therein a compressed air space;

wherein the cylinder has an outer peripheral surface, an inner peripheral surface, one end, and another end, the at least one compressed air introduction hole being formed at the another end, and the at least one compressed air flowage hole being positioned near the another end, the return chamber being defined between the inner peripheral surface of the outer frame and the outer peripheral surface of the cylinder;

wherein the sleeve piston has an inner peripheral surface defining the inner space and an outer peripheral surface defining the outer space, and having one end, a longitudinally intermediate portion, and another end serving as the abutment end, the first communication hole being positioned at the intermediate portion;

wherein the first seal member is disposed at the another end of the sleeve piston and in sealing contact with the inner peripheral surface of the cylinder, the first seal member being located further from the shut-off section than the second seal member to the shut-off section;

wherein the bumper is disposed at the another end of the cylinder; and wherein the shaft member has one end portion provided with the hollow section in communication with the compressed air space, the piston section being slidably movable with respect to the inner peripheral surface of the sleeve piston.

10. A pneumatically operated screw driver comprising:

an outer frame;

a pneumatic motor disposed in the outer frame and rotatable about its axis;

a cylindrical rotary member extending in an axial direction of the pneumatic motor and rotatable within the outer frame by the rotation of the pneumatic motor, the rotary member having an inner peripheral surface formed with a rotation transmission portion;

a rotation slide member disposed within the rotary member and slidable in the axial direction relative to the rotary member, the rotation slide member comprising a main section and an engagement portion protruding from the main section for engagement with the rotation transmission portion so as to be rotatable together with the rotation of the rotary member, at least the main section being entirely made from an elastic material;

a shaft member having one end portion connected to the rotation slide member and another end portion provided with a driver bit holding section and a piston section;

a driver bit connected to the driver bit holding section;

a cylinder fixedly disposed in the outer frame and extending in the axial direction, the cylinder having an upper portion providing a shut-off section in sealing contact with at least the main section of the rotation slide member when the piston section reaches its bottom dead center for shutting off a compressed air passage directing to the pneumatic motor.

11. The pneumatically operated screw driver as claimed in claim 10, wherein the elastic material is an urethane rubber, and wherein the rotary member comprises a main rotary member made from a plastic material having an end at a side opposite to the pneumatic motor, and a sliding segment fixed to the end of the main rotary member and made from a metal.

12. The pneumatically operated screw driver as claimed in claim 10, wherein the cylinder is formed with at least one compressed air introduction hole and at least one compressed air flowage hole, a return chamber being defined between the outer frame and the cylinder so that a compressed air is flowed from the cylinder to the return chamber through the air flowage hole and is flowed from the return chamber into the cylinder through the air introduction hole.

13. The pneumatically operated screw driver as claimed in claim 12, further comprising:

a sleeve piston slidably disposed in the cylinder and movable in the axial direction of the cylinder between its top dead center and a bottom dead center, the sleeve piston defining an inner space and an outer space and being formed with a first communication hole permitting fluid communication between the inner space and the outer space, the sleeve piston having an abutment end;

a first seal member disposed at the sleeve piston and in sealing contact with the cylinder;

a second seal member disposed at the sleeve piston and in sealing contact with the cylinder, the second seal member being positioned closer to the shut-off section than the first seal member to the shut-off section;

a bumper disposed at the cylinder, the abutment end of the sleeve piston and the piston section being abuttable on the bumper, the shaft member having a hollow section, an intermediate section, and another end portion provided with the piston section, at least the intermediate section and the another end portion being disposed in the inner space of the sleeve piston, and the piston section being slidably movable with respect to the sleeve piston, a second communication hole being formed at the intermediate section in communication with the hollow section and the inner space of the sleeve piston, the air flowage hole being positioned to allow compressed air in the inner space to direct into the return air chamber through the first communication hole after the first seal member moves past the air flowage hole during movement of the sleeve piston toward its bottom dead center and after the piston section passes the first communication hole and before the piston section reaches its bottom dead center.

14. The pneumatically operated screw driver as claimed in claim 12, wherein the outer frame has an inner peripheral surface and defines therein a compressed air space;

wherein the cylinder has an outer peripheral surface, an inner peripheral surface, one end, and another end, the at least one compressed air introduction hole being formed at the another end, and the at least one compressed air flowage hole being positioned near the another end, the return chamber being defined between the inner peripheral surface of the outer frame and the outer peripheral surface of the cylinder;

wherein the sleeve piston has an inner peripheral surface defining the inner space and an outer peripheral surface defining the outer space, and having one end, a longitudinally intermediate portion, and another end serving as the abutment end, the first communication hole being positioned at the intermediate portion;

wherein the first seal member is disposed at the another end of the sleeve piston and in sealing contact with the inner peripheral surface of the cylinder, the first seal member being located further from the shut-off section than the second seal member to the shut-off section;

wherein the bumper is disposed at the another end of the cylinder; and wherein the shaft member has one end portion provided with the hollow section in communication with the compressed air space, the piston section being slidably movable with respect to the inner peripheral surface of the sleeve piston.

15. The pneumatically operated screw driver as claimed in claim 10, wherein the main section and the engagement section are integral with each other and are entirely made from the elastic material.

16. The pneumatically operated screw driver as claimed in claim 10, wherein the engagement section is made from a material different from a material of the main section.

* * * * *